US005971009A

United States Patent [19]

Schuetz et al.

[11] Patent Number: 5,971,009

[45] Date of Patent: Oct. 26, 1999

[54] DUAL CONTAINMENT ASSEMBLY

[75] Inventors: Reinhard Schuetz, Calgary; Ernest Jacobson, Sylvan Lake; Roger Charest, Calgary, all of Canada

[73] Assignee: TankSafe Inc., Calgary, Canada

[21] Appl. No.: 08/795,246

[22] Filed: Feb. 10, 1997

[51] Int. Cl.[6] ..... F16K 43/00; F16K 27/00; F16K 49/00

[52] U.S. Cl. ..... 137/312; 137/264; 137/315; 137/341; 137/375; 137/429; 137/587; 220/560.1

[58] Field of Search ..... 137/264, 312, 137/386, 392, 409, 429, 583, 584, 587, 341, 315, 375; 220/4.12, 560.1

[56] References Cited

U.S. PATENT DOCUMENTS

| | | | |
|---|---|---|---|
| 1,000,619 | 8/1911 | Miller et al. | 137/587 |
| 1,327,693 | 1/1920 | Bewan | 137/587 |
| 1,628,069 | 5/1927 | Schmidt et al. | 137/587 |
| 2,577,171 | 12/1951 | Wiggins et al. | 220/560.1 |
| 3,076,317 | 2/1963 | La Fave | 220/560.1 |
| 3,545,226 | 12/1970 | Newell | 62/384 |
| 4,259,975 | 4/1981 | Kinsey, Jr. et al. | 137/392 |
| 4,638,920 | 1/1987 | Goodhues | 220/445 |
| 4,697,618 | 10/1987 | Youtt et al. | 137/587 |
| 4,884,711 | 12/1989 | Bomhard et al. | 220/560.1 |
| 4,895,272 | 1/1990 | De Benedittis et al. | 137/312 |
| 4,924,897 | 5/1990 | Brown | 137/587 |
| 4,939,833 | 7/1990 | Thomas | 29/401 |
| 4,971,214 | 11/1990 | Lillywhite et al. | 220/54 |
| 4,989,447 | 2/1991 | Gelin | 73/49.2 |
| 5,000,342 | 3/1991 | Sharp | 220/454 |
| 5,096,087 | 3/1992 | Thomas | 220/4.12 |
| 5,134,683 | 7/1992 | Powell | 137/312 |
| 5,220,823 | 6/1993 | Berg et al. | 73/49.2 |
| 5,251,473 | 10/1993 | Reese | 73/49.2 |
| 5,285,914 | 2/1994 | Del Zotto | 220/4.12 |
| 5,299,709 | 4/1994 | Beerbower et al. | 220/445 |
| 5,421,478 | 6/1995 | Lovato | 220/565 |

*Primary Examiner*—George L. Walton
*Attorney, Agent, or Firm*—Thomas E. Malyszko

[57] ABSTRACT

A containment assembly for storing a liquid substance above a ground support surface has an inner tank for receiving and storing the liquid and an outer tank surrounding the inner tank and forming a first air space therebetween for trapping any of the liquid which might escape said inner tank. A support beneath the outer tank provides a second air space between the outer tank and the ground support surface, and a thermal insulating layer substantially envelopes the inner tank, outer tank and support from the ambient. A vapour exhaust vent is provided atop the inner tank, which may include a liquid scrubber for recovering liquids from discharging gases and returning the liquids to the inner tank or elsewhere. Piping is provided for liquid communication between the inner tank and external liquid sources for filling and emptying the inner tank. Instrumentation for measuring the amount of liquid in the inner tank includes a shut-off mechanism for stopping the flow of liquid through the piping to the inner tank when the liquid reaches a pre-set level in the tank. A detector accesses the first air space for detecting liquid leakage from the inner tank. Air exchange is promoted between the first and second air spaces by a plurality of open ended standpipes spaced about the first air space and in air communication with the second air space. A heater is preferably provided for forcing heat into the second air space, the heat being distributed through an the standpipes into the first air space and about the inner tank. A second inner tank may be located beneath the outer tank for liquid storage, and may be partitioned for handling selected liquids.

32 Claims, 6 Drawing Sheets

DUAL CONTAINMENT ASSEMBLY

FIELD OF THE INVENTION

The present invention relates to tanks for storing liquid substances, and in particular to dual wall containment tanks for storing liquid substances used in the petroleum industrial, agricultural and petro-chemical industries.

BACKGROUND OF THE INVENTION

There are a variety of tanks available for storing various substances both belowground and aboveground. Existing underground tanks suffer from many drawbacks, some of which render such tanks unusable as a result of more stringent modern day environmental guidelines and requirements. One drawback is that underground tanks tend to leak their contents, whether through corrosion or other causes such as breaks due to ground movements. Leaks are typically very difficult to detect, and, once detected, it is virtually impossible to tell how long the leak has been present. Such tanks not only require expensive excavation to install, but require further excavation for removal, repair or replacement. Underground tanks are usually replaced rather than repaired due to impacts and damage during excavation and repair. Reclaiming a contaminated site is also very time consuming and expensive. Underground tanks used in the petroleum industry further require berms and dykes which claim a large surface area at well sites, and make access to the tank more difficult. Removing product from such tanks is expensive due to required use of vacuum trucks rather than less expensive pump trucks.

Aboveground tanks, on the other hand, avoid some of these problems. They do not require excavation, for instance, but may require berms depending on whether the tank is single or double walled. Existing aboveground designs have their own drawbacks, particularly in extreme cold (or hot) climates. Keeping stored liquid from freezing and damaging the tank usually requires more than just thermal insulation but a heating system of some sort. A disadvantage of prior art systems is that they focus on heating the liquid itself, which can be expensive and impractical. Hence, usage of aboveground tanks in such extreme climates is not as popular as it should be, even though from an environmental standpoint, leak detection is much easier and quicker to detect than in underground tanks.

What is desired therefore is a novel aboveground tank assembly for storing liquid substances which overcomes the limitations and problems of these prior art tanks. Preferably it should provide a dual containment assembly where a sizeable air space between an inner tank for receiving and storing the liquid and outer tank is provided to trap any leakage from the inner tank. A means for readily detecting any leak should be provided, and a shut-off mechanism should be available to stop liquid flow and prevent overflow of the inner tank. Preferably the novel tank should have another air space beneath the outer tank communicating with the first air space, and a heater for heating these air spaces whereby the stored liquid is prevented from freezing by the surrounding air spaces rather than direct heating of the liquid. An air exchange assembly should provide for air communication between air spaces, yet prevent any leaked liquid in the first air space from entering the second air space. The assembly should be enveloped and effectively isolated from the ambient by an insulating layer. The assembly should further provide for storage of more than one type of liquid, and for a means of at least partially separating solids from the liquid. It should also provide a vent for the inner tank which reclaims at least some moisture from vented gases and returns the moisture to the assembly.

In a preferred aspect the present invention provides an aboveground containment assembly for storing liquids comprising:

- an inner tank for receiving and storing said liquids;
- an outer tank surrounding said inner tank and forming a first air space therebetween for trapping any of said liquids which might escape said inner tank;
- a support means beneath said outer tank for providing a second air space between the outer tank and a ground support surface;
- an insulating layer for substantially isolating said inner tank, outer tank and support means from the ambient;
- a vapour exhaust means for said inner tank;
- pipe means for liquid communication between said inner tank and external liquid sources for filling and emptying said inner tank;
- measurement means for measuring the amount of liquid in said inner tank and including a shut-off mechanism for stopping the flow of liquid through said pipe means to said inner tank upon said liquid reaching a pre-set level therein; and
- a detector accessing said first air space for detecting liquid leakage from said inner tank.

In another aspect the invention provides a containment assembly for liquid storage comprising:

- an outer tank located aboveground;
- an upper inner tank for primary liquid storage located within said outer tank so as to form a first air space therebetween for containing any egress of liquid from said upper tank;
- a sub-floor assembly beneath said outer tank for elevating and supporting a base of said outer tank aboveground and to form a second air space beneath said outer tank base;
- an external insulating layer for substantially isolating said upper inner tank, outer tank and sub-floor assembly from the ambient;
- a vapour and pressure exhaust means for said upper inner tank;
- inlet and outlet pipe means for filling and emptying said upper inner tank;
- measurement means for measuring the amount of liquid in said upper inner tank and including a shut-off mechanism for interrupting the flow of liquid through said pipe means upon said liquid reaching a pre-set level within said upper inner tank; and
- a detector accessing said first air space for detecting liquid therein.

DESCRIPTION OF THE DRAWINGS

Embodiments of the invention will now be described, by way of example only, with reference to the accompanying drawings, wherein.

DESCRIPTION OF PREFERRED EMBODIMENTS

Figure 1:
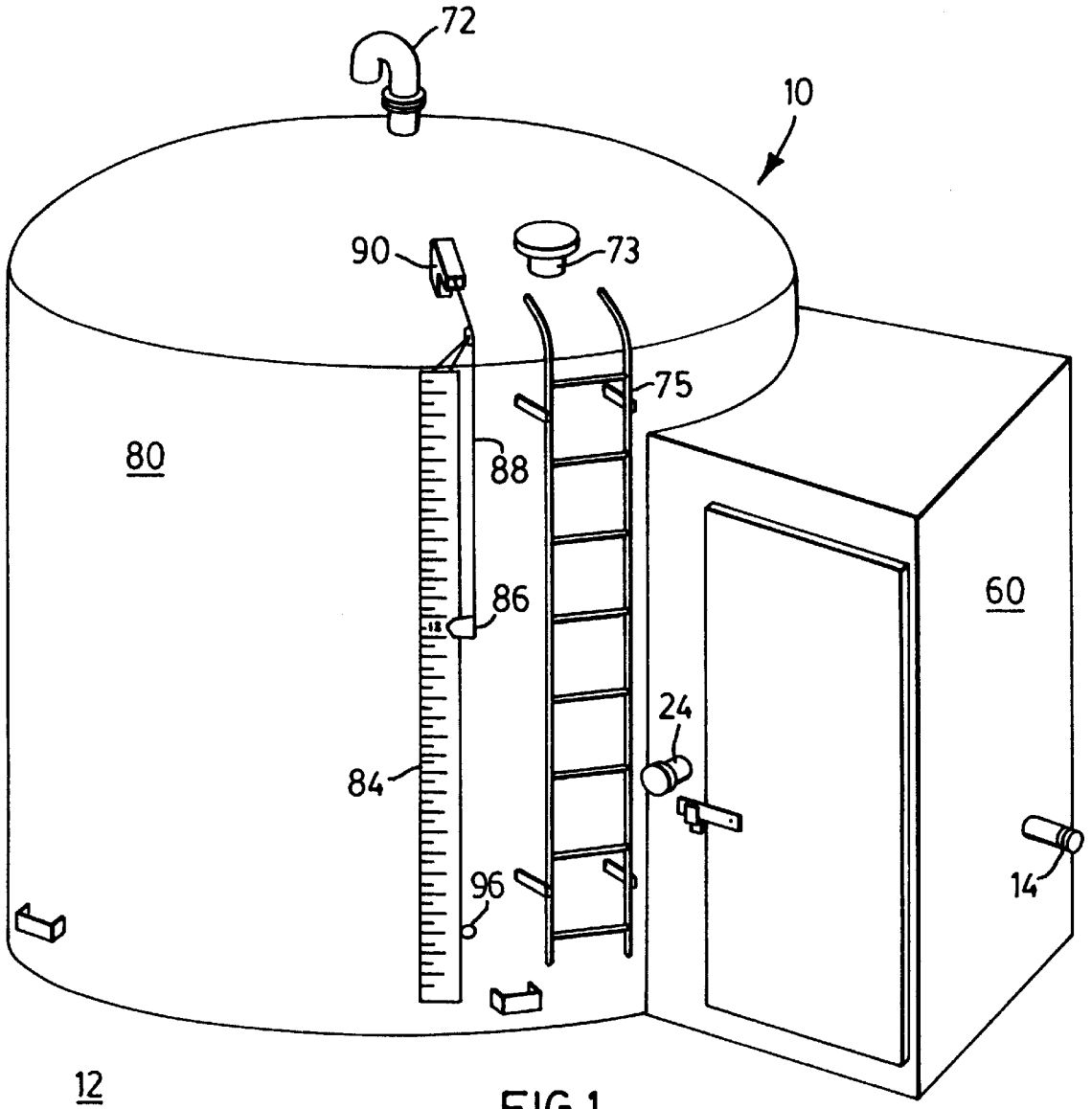
FIG. 1 is a perspective view on the exterior of a containment assembly according to a preferred embodiment of the present invention.
Figure 2:
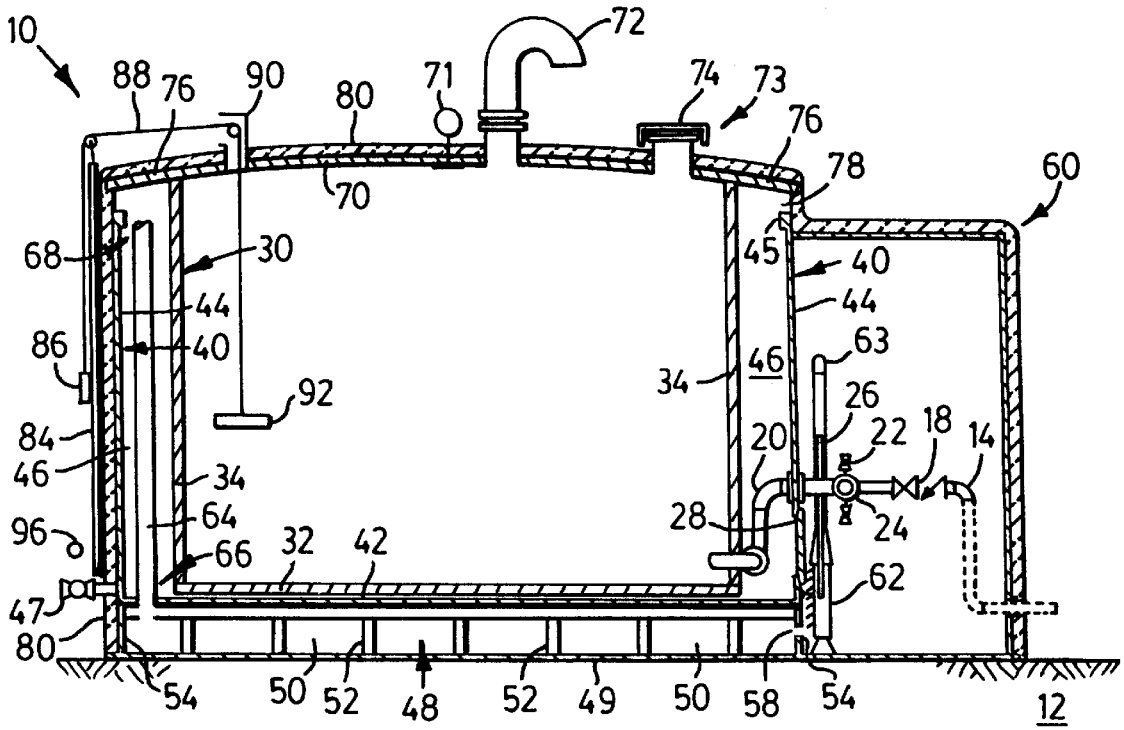
FIG. 2 is an elevation view in cross-section of the containment assembly of FIG. 1.
Figure 3:
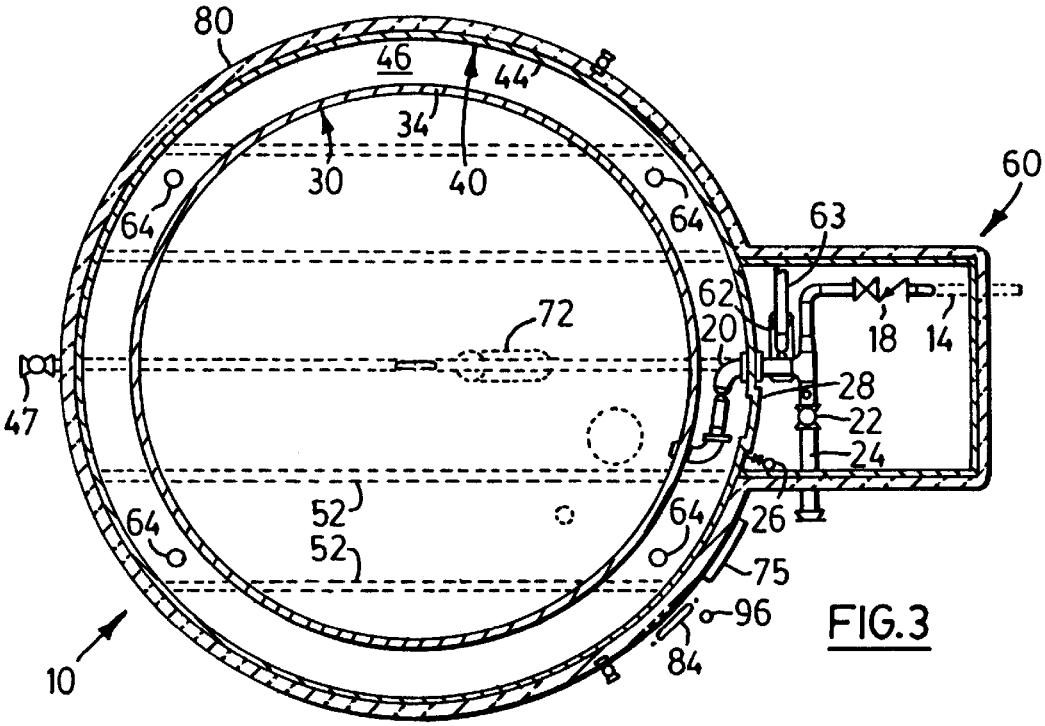
FIG. 3 is a sectional plan view in cross-section of the containment assembly of FIG. 1.

Reference is first made to FIGS. 1, 2 and 3 which show a preferred embodiment of a containment assembly 10 for storing a liquid substance (not shown) above grade or ground level 12. The liquid substance may be any one of a number of liquids capable of fluid flow which is encountered in the petroleum industry (such as methanol, lube oil, diesel fuel, produced water, etc.), the agricultural industry (such as liquid fertilizers, pesticides, etc.), the petro-chemical industry (such as chemicals, contaminated wastes, etc.), as well as industrial and recreational sites (such as storage of potable water and sewage at camp sites, etc.). The liquid may often contain suspended solids of some sort. For illustrative purposes and ease of reference, produced water is used herein as the fluid substance. "Produced water" is in essence gas-tainted water which is separated from natural gas that is pumped out of gas wells. Such separation is typically done on site at the well site. Since the produced water normally contains toxins, it must be safely stored apart from the gas in a container near the well head for later removal and treatment.

In the present invention, the produced water is transferred from the well head to the containment assembly through one or more first inlet pipes 14. A shut-off mechanism connected to an emergency shut-down ("ESD") valve 18 is provided to cut off flow of the produced water into the assembly 10. The ESD valve 18 may be located elsewhere along the inlet pipes 14, such as outside the shed 60. The shut-off mechanism for triggering the ESD valve 18 is described in greater detail later. The produced water passes from the first inlet pipe 14 through a second inlet pipe 20 and empties into an inner tank 30 which receives and stores or holds the produced water. The inner tank 30 has a substantially planar circular base plate 32 joined with an upstanding continuous cylindrically-shaped side wall 34. The base plate 32 and side wall 34 may be of a unitary construction, or may be of a multi-piece construction attached or bonded in a fluid tight manner. The mouth of the second inlet pipe 20 is advantageously located slightly above the bottom of the inner tank so that some produced water always remains at the bottom of the inner tank, even after draining through outlet pipe 24. The residual produced water slows down the pressurized produced water exiting the second inlet pipe 20, thus absorbing its energy to avoid damaging the inner tank by liquid impact.

The inner tank 30 sits within and is surrounded by a larger outer unit or tank 40 for trapping or containing any produced water which might escape from the inner tank 30. The outer tank 40 has an open top and a substantially planar circular floor 42 sealingly joined to an upstanding continuous outer shell or side wall 44 which is coextensive with the inner side wall 34. A stiffening ring 45 may be provided at or near the top of the outer shell 44. The base plate 32 sits on and is supported by the floor 42, while the outer shell 44 is radially spaced from the inner side wall 34 generally uniformly about the containment assembly to form a first air space or void space 46. The air space 46 should be sized to avoid overflow of produced water out of the outer tank should the inner tank develop a serious leak. It is accepted practice that the size of air space 46 should be at least about 110% of the volume of the inner tank 30. In the preferred embodiment the air space 46 does not extend between the base 32 and the floor 42, although such a void may be created if desired. Should produced water enter and accumulate in the air space 46, a number of exit valves 47 are located at the bottom of the air space just above the floor 42 for purging produced water out of the outer tank.

A base portion or sub-floor 48 beneath the outer tank 40 elevates the tank floor 42 above grade 12 and creates a second air space 50. The sub-floor consists of a plate 49 of suitable material such as metal, which may be placed on level soil or gravel, as desired. The sub-floor has numerous individual steel supports 52, allowing for heat transfer throughout the sub-floor 48. The outer shell 44 of the outer tank 40 extends only as far as the top of the sub-floor, and so a separate circumferential shell 54 envelopes or encloses the second air space 50, forming an outer perimeter thereabout. The sub-floor shell 54 is not formed integrally with the outer shell 44 to allow the outer tank to be lifted or removed from the sub-floor without having to cut the shell. The outer perimeter 54 is pierced by one or more holes 58 adjacent a utility shed 60 which houses, inter alia, the inlet and outlet pipes 14, 20 & 24. A heater 62 is located by the hole 58 for introducing heat into sub-floor 48 adjacent to the hole which then permeates the entire second air space 50. The heater's exhaust vent is indicated at 63.

An important feature of this containment assembly is the provision of a number of hollow standpipes 64 circumferentially spaced about the outer tank in the first air space 46. Each standpipe 64 in the preferred embodiment is a vertically oriented hollow metal pipe having a bottom end 66 in air communication with the second air space 50 and a top end 68 in air communication with the first air space 46. The standpipe 64 is supported on the floor 42 and is joined thereto in a fluid tight matter to prevent leakage from the first to the second air space 46, 50. An open top end 68 of the standpipe 64 is located at about the same height as the top edge 36 of outer side wall 34 to prevent ingress of produced water into the standpipe, and consequently into the sub-floor 48, should the produced water leak from the inner tank 30 into the first air space 46. The standpipes 64 allow the heated air in the lower air space 50 to migrate upwardly and into the upper air space 46, thus heating the upper air space. The heating is achieved by convection, namely currents of warm air entering the upper air space from the standpipes, and by radiant transfer of heat from the pipe wall to the inner tank sidewall 34. Four standpipes are shown for the preferred embodiment, although it will be appreciated that the number may vary depending on such factors as the volume of airspace to be heated. The standpipes are preferably evenly spaced circumferentially, but other spacings may be more suitable depending on local conditions (for instance more standpipes may be provided on the side of the containment assembly from which prevailing cold winter winds are encountered). It will further be appreciated that the standpipes need not be straight but could be curved and bent into different shapes to enhance distribution of heat circumferentially about the inner tank. However, such shaping is not preferred due to increased production cost, and because good results have been realized with the straight shapes shown.

The inner tank 30 has a circular shaped roof 70 which is supported on and connected to the top perimeter of sidewall 34. It is important that the connection be of sufficient strength so that the roof and inner tank may be removed as one unit from the outer tank by lifting the roof using hook 71 and a crane or other hoisting means. The roof is slightly bowed or arched upwardly to encourage and direct any precipitation to travel off the roof. A vapour exhaust or vent 72 accesses the inner tank at or near the roof's highest point, namely the centre in the FIG. 2 embodiment. FIG. 2 shows a standard vent having a 180 degree bend so that the open exterior end faces downwardly to discourage ingress of precipitation or other foreign substances. An alternate embodiment of the vent is described later.

A roof mounted blow down vent or port 73 of, say, 8 inch diameter pipe provides a means of relieving excessive pressure build-up in the inner tank which may from time to time exceed the venting capacity of the vent 72. In the FIG. 2 embodiment, the flanged lid 74 is slideably located on several long, slender rods or wires (not shown) extending from the port's periphery so that excessive inner tank gas pressure will lift the lid for escape to the ambient, and then the rods will guide the falling lid back into position atop the port. Alternately, the lid 74 may be hinged at one side and have a string, spring or other means on the other side for returning an open lid to a properly closed position. A larger manway may be located on the roof if desired to provide workers access into the inner tank for inspection and/or repairs. A ladder 75 to the port 73 should also be provided outside the containment assembly.

The outer periphery of the roof 70 forms an overhanging portion 76 extending radially outwardly from the inner tank sidewall 34 over the upper air space 46 and terminates just above the outer shell 44 of the outer tank. Preferably the overhang 76 is not attached to the outer shell, leaving a small gap 78 therebetween. This arrangement allows the inner tank to be lifted out of the outer tank without having to detach the roof from the outer tank side wall.

A utility shed 60 located adjacent the outer tank 40 houses the inlet and outlet pipes 14, 20, 24, valves 18, 22 and the heater 62 as shown in FIGS. 2&3. A pump may be provided within the shed to allow transfer of produced water out of the inner tank 30 by reversing flow through pipe 20 and discharging the water through outlet pipe 24. Periodically, the produced water must be drained from the inner tank to a tanker truck via the control valve 22 and the outlet pipe 24. A detector 26 for detecting leaks of produced water out of the inner tank is also located in the shed. In the preferred embodiment the detector is a sight glass arrangement which pierces the outer shell 44 to penetrate the upper air space for visual leak inspection thereof. Any produced water sighted in the air space indicates a leak of the inner tank. In alternate embodiments electronic sensors may be located in the upper air space which trigger alarms upon detecting produced water in the air space. Such sensors may also be adapted to trigger a shut-off mechanism, such as the ESD valve 18, to disrupt flow into the inner tank, as is known in the art. The shed also encloses an inspection hatch 28 for accessing the first air space 46 and the second inlet pipe 20, for instance when disconnecting the pipe 20 from the inner tank 30 for removal of the inner tank from the outer tank 40.

Figure 4:
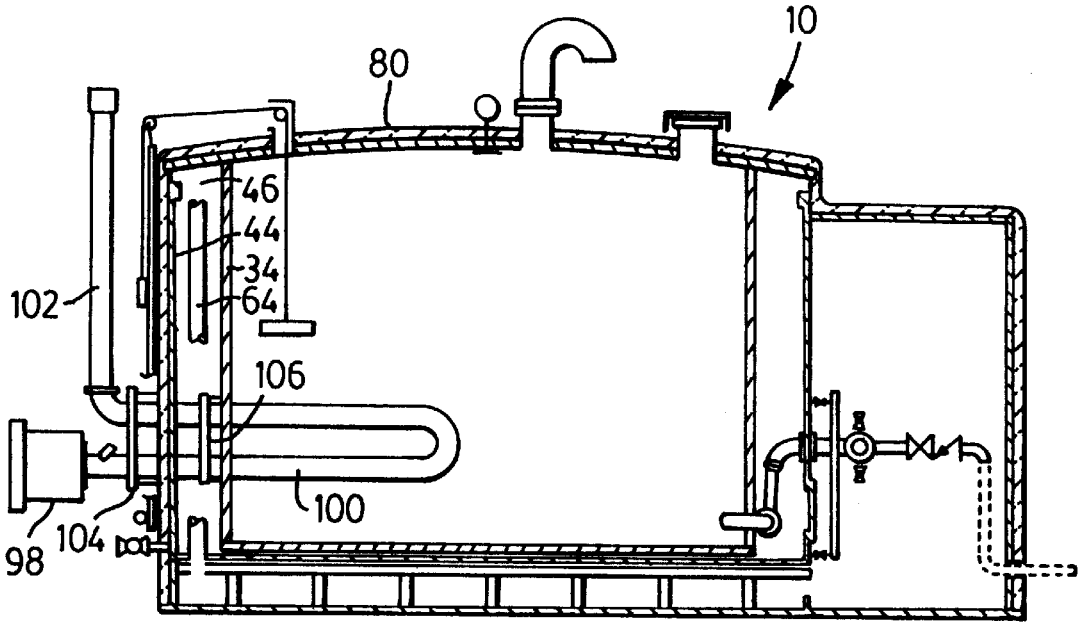
FIG. 4 is an elevation view similar to FIG. 2 showing a fire tube heating arrangement according to a second embodiment of the present invention.

Another important feature of the invention is a thermal insulation layer or barrier 80 which envelopes or surrounds the containment assembly, including the shed 60, as shown in FIGS. 1, 2 and 4. The insulation covers and adheres to the outer shell 44 along its entire height and over the shell 54 right down to grade 12 so as to include the sub-floor 48. The insulation extends from the outer shell 44 over the gap 78 and onto the outside surface of the roof 70, and so effectively encloses the inner tank 30 as well as both the upper and lower air spaces 46, 50. A number of small opening may be made in the insulation at the gap 78 if increased air circulation in the air spaces is needed to vent any moisture due to temperature condensation or the like. The insulation is not required on the portion of the outer shell 44 enclosed by the shed 60 since the insulation extends about the periphery of the shed. It will be appreciated that the insulation may in effect envelope the shed by constructing it with prefabricated insulated panels. The port 73 and the vent 72 are not covered with the insulation 80. In the preferred embodiment, therefore, the containment assembly is virtually completely thermally isolated from the ambient, which is very desireable in cold, hot, or other hostile climates.

The containment assembly preferably incorporates a means for measuring the level or amount of produced water in the inner tank 30. Such means can range from complex data acquisition equipment employing remote sensing technology, to simple mechanical device deployed on-site. FIGS. 1&2 illustrate one such simple measuring assembly employing an external gauge board 84 with a slideable indicator 86 operatively connected by a line 88 through opening 90 to a float 92 within the inner tank. The volume of product inside the inner tank is therefore readily shown on the board 84.

The measuring assembly further cooperates with a shut-off mechanism for disrupting or stopping the flow of produced water into the inner tank. In the preferred embodiment a pneumatic shut down switch 96 (indicated in FIGS. 1&2) is located near the lower end of the gauge board 84. The location is selected so that as the produced water in the inner tank reaches a pre-set maximum volume or level, the indicator 86 reaches and trips the switch 96. The switch in turn activates the EDS valve 18, thereby stopping the flow of produced water through the inlet piping 14, 20. The switch is simply a precautionary measure since the inner tank capacity will be chosen taking into account the anticipated maximum flow or production of produced water and the frequency with which the tank is to be emptied. It will be appreciated that the switch 96 may be any one of a variety of types, such as electromechanical, photo-electric, magnetic, etc.

Figure 5:
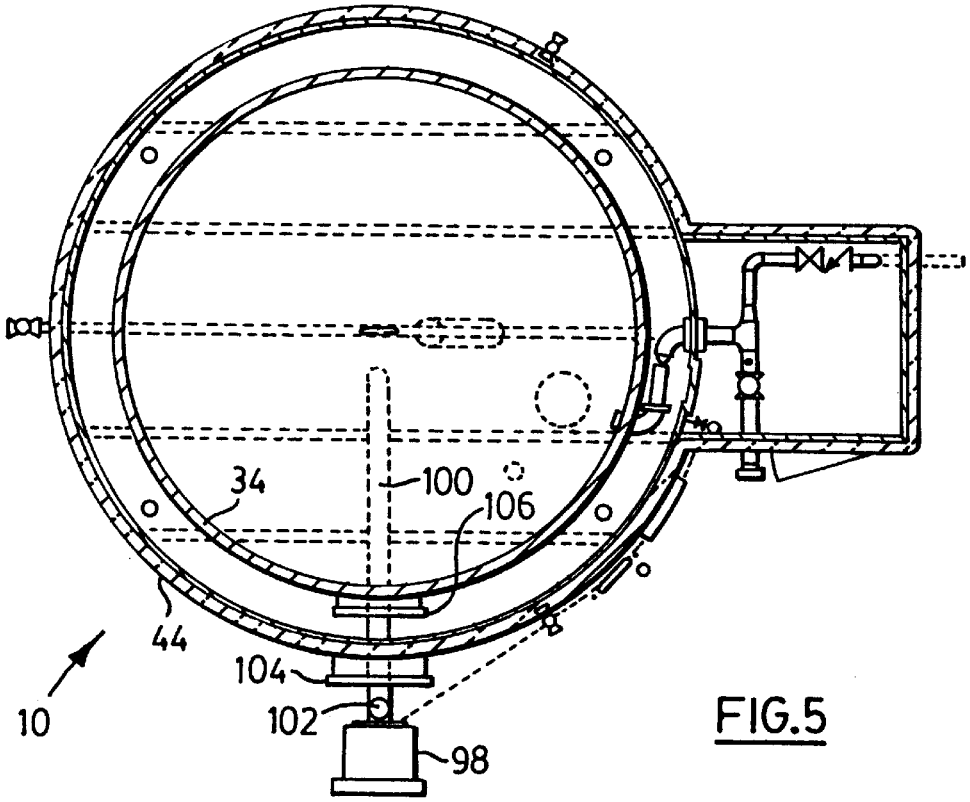
FIG. 5 is a sectional plan view of the FIG. 4 embodiment.
Figure 6:
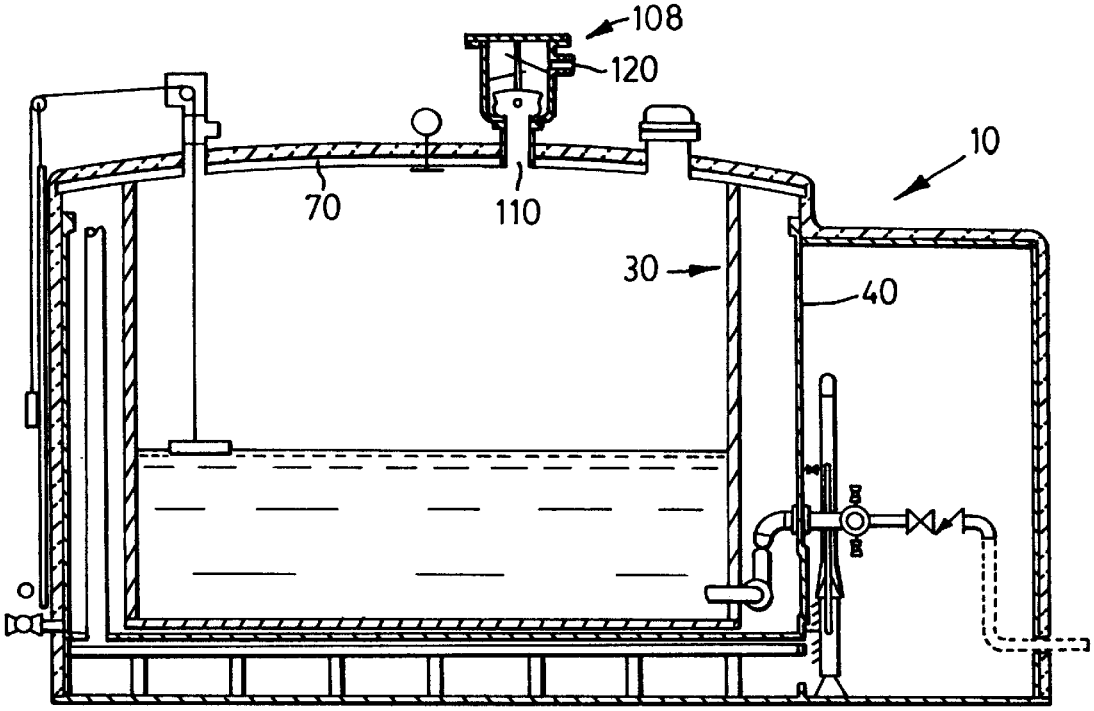
FIG. 6 is an elevation view similar to FIG. 2 showing a liquid scrubber type vent according to a third embodiment of the present invention.
Figure 7:
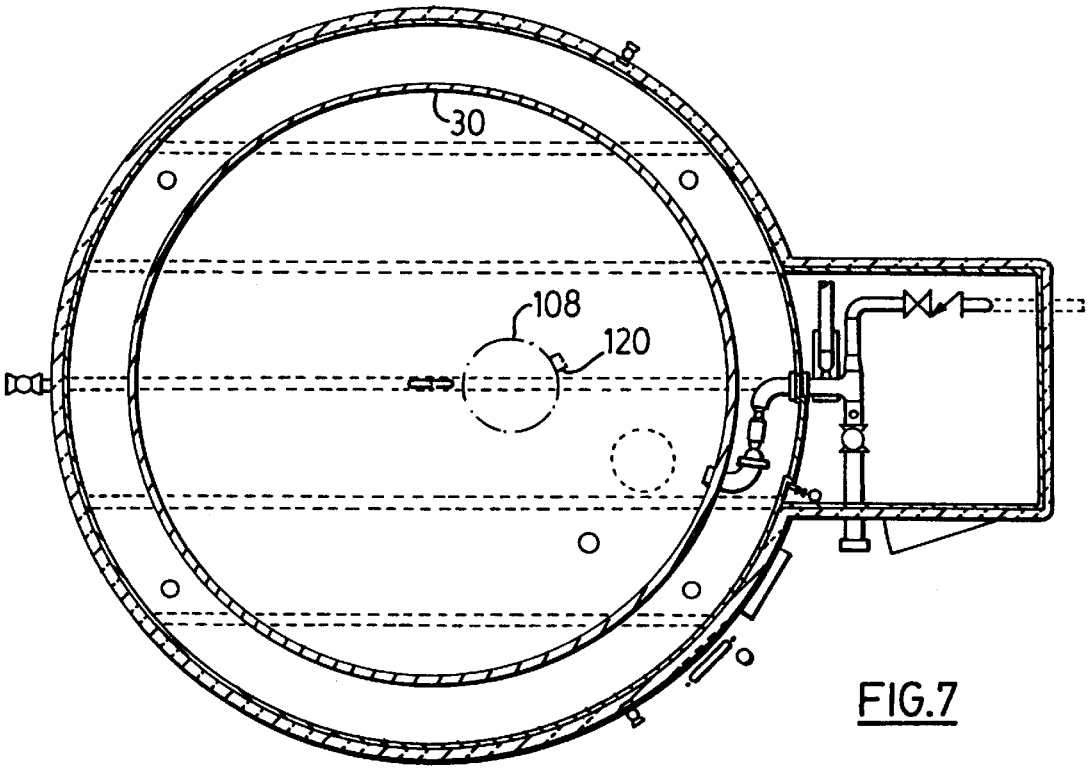
FIG. 7 is a sectional plan view of the FIG. 6 embodiment.
Figure 8:
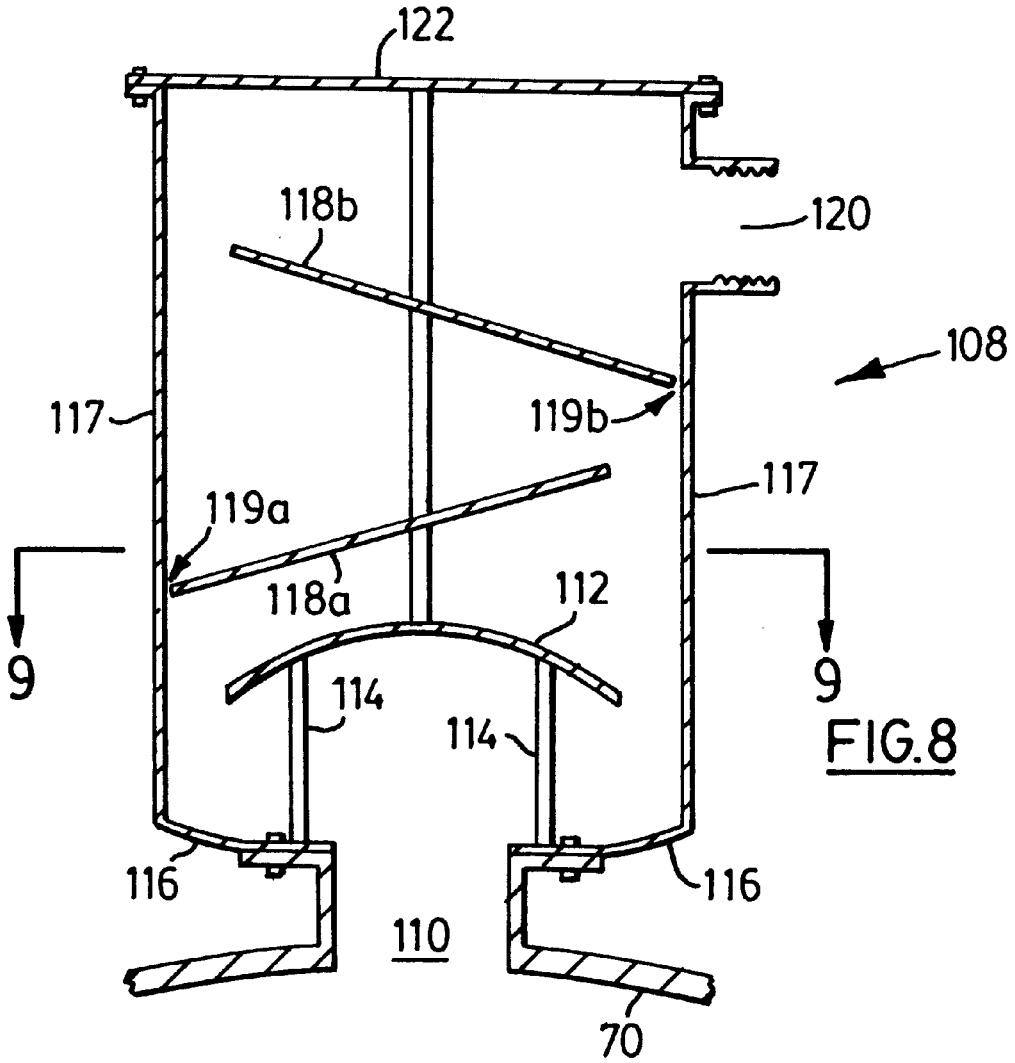
FIG. 8 is an elevation view in cross-section of the vent of FIG. 6.
Figure 9:
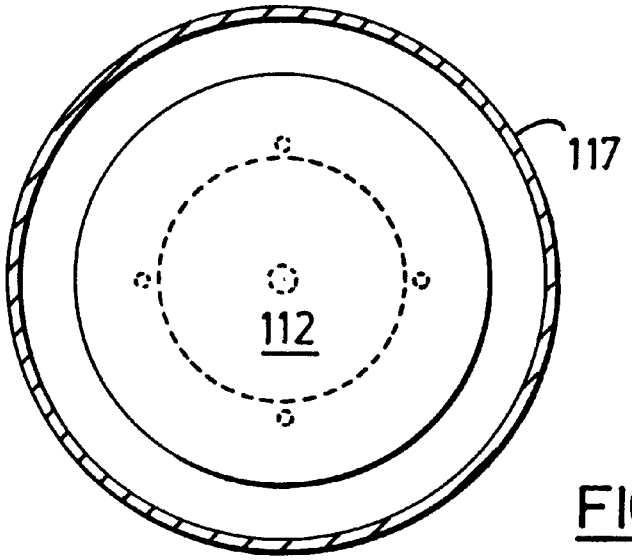
FIG. 9 is a plan view of the vent of FIG. 8.

FIGS. 4&5 show a second embodiment of the invention in which the heater 62 within the insulating layer is substituted by a fire-tube type heater 98 located outside the insulating layer 80, although the fire-tube heater 98 may be added in addition to the heater 62 as a back-up heating system if desired. The fire-tube heater delivers heat directly into the inner tank 30 and the produced water within. The heater 98 transmits heated air within an inlet conduit 100 which extends into the inner tank 30 through both the outer shell 44 and sidewall 34 in a sealingly type manner. The inlet conduit extends within the inner tank a sufficient distance for the desired transfer of heat thereinto. The inlet conduit 100 is then looped or extended back out of the inner tank to vent the circulated air through an outlet conduit 102 to the ambient. A joining plate 104 provides access into the conduits 100, 102 for cleaning and maintenance from outside the insulating layer 80, and likewise another joining plate 106 is provided within the first air space 46 so that the conduits on either side of the plate 106 may be disengaged so as not to obstruct removal of the inner tank out of the outer tank, should such operation be required.

In a third embodiment of the invention shown in FIGS. 6–9, the vent 72 is substituted with a liquid scrubber 108 to recover liquids from gases exiting the inner tank and discharging through the scrubber, and to return these recovered liquids back into the inner tank. The scrubber has an inlet portion 110 through which the gases enter the scrubber. Upon entry, the upward gas flow is first intercepted or obstructed by a concave plate 112 supported on pillar-like legs 114 which forces the gas flow around the sides of the plate 112. The plate's shape forces any liquid condensed thereon to fall onto a lower scrubber surface 116 and return into the inner tank via inlet portion 110. The exiting gas next encounters two (or more) baffle members 118*a,* 118*b* which are angled upwardly away from the scrubber wall 117 and are arranged in a vertically stacked relationship on a central support as shown to form a snaking passage within the scrubber. As the rising gases flow through the passage toward an outlet portion 120 for escape to the ambient or other closed system for collection, they contact the baffle surfaces which facilitate or promote condensation of liquids thereon. Liquids collected on the baffles are urged by gravity to trickle down the baffles and through gaps 119*a* and 119*b* to the bottom of the scrubber and back into the inner tank. A bolted cover 122 atop the scrubber provides interior access for maintenance and repairs.

Figure 10:
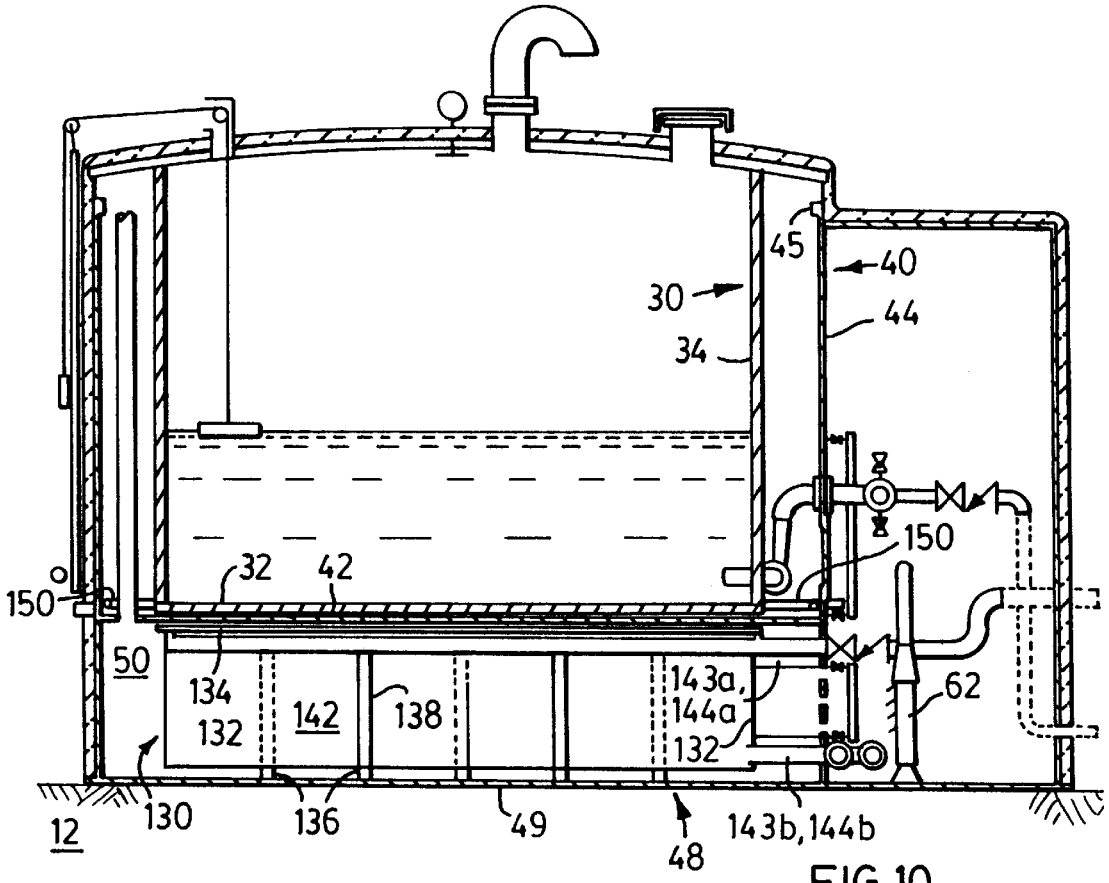
FIG. 10 is an elevation view similar to FIG. 2 showing a second lower inner tank according to a fourth embodiment of the present invention; and, FIG. 11 is a sectional plan view of the FIG. 8 embodiment.
Figure 11:
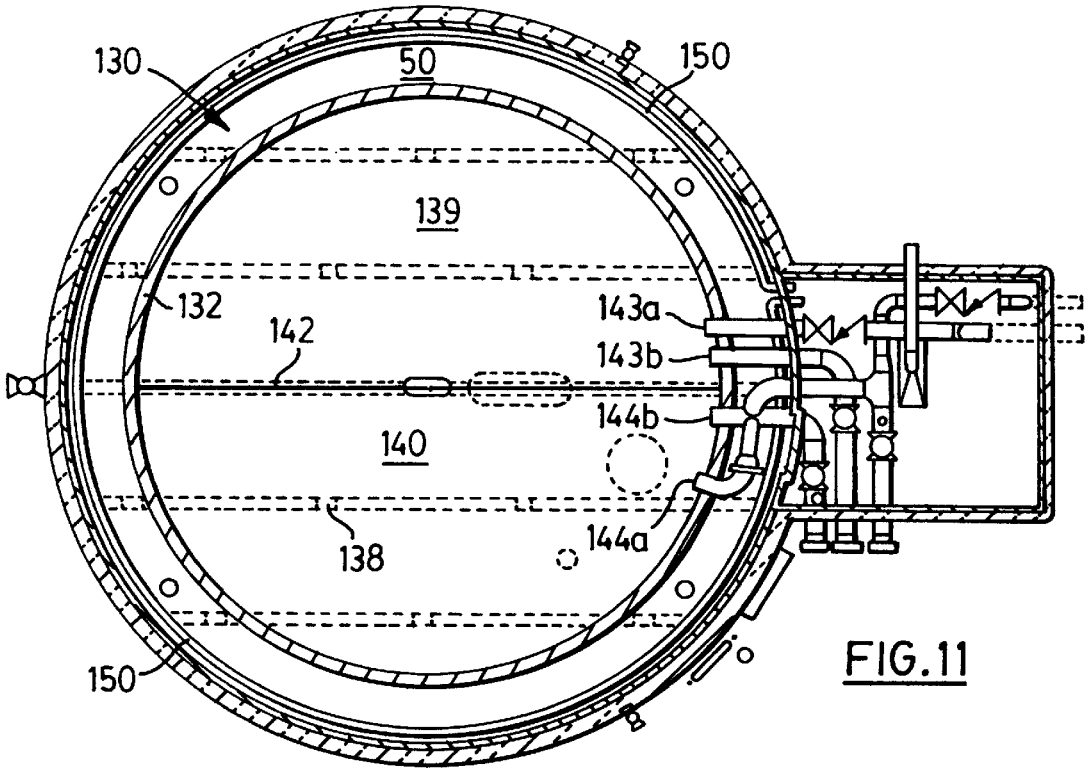

FIGS. 10 and 11 show a fourth embodiment of the invention where the sub-floor 48 and second air space 50 incorporate or house a second or lower inner tank 130. In FIGS. 10,11 similar reference numerals designate like features of the preferred embodiment. The peripheral sidewall 132 is of a similar diameter to that of the upper inner tank 30, and a removable metal plate-like lid 134 caps the lower tank 130 to discourage entry of foreign matter. The floor 42 of the outer tank 40 sits on and is supported by lid 134. A plurality of first supports 136 elevate the lower tank 130 above the ground plate 49 for extending the second air space 50 to provide air and heat circulation thereunder. The first supports are vertically aligned with corresponding second supports 138 extending through the lower tank and engaging the underside of lid 134, thereby transferring load from the outer tank 40 to the grade through first supports 136. The underside of the lid 134 has clasps (not shown) which engage the second supports to prevent lateral movement and keep them vertically alligned. The lower tank 130 may be accessed by removing the outer tank 40.

In the FIGS. 10/11 embodiment the lower tank 130 is partitioned into two container areas 139 and 140 by an upstanding central wall or divider 142 for selective storage of one or more liquids. Each container area 139 and 140 has a dedicated set of inlet and outlet pipes 143*a,* 143*b* and 144*a,* 144*b,* respectively, for handling selected liquids. In this embodiment the divider 142 also allows selective migration of liquids between the container areas 139, 140. The divider wall 142 is built lower than the peripheral sidewall 132, and so as liquid is pumped into, say, the first container area 139, it may overflow into the second container area 140 over the divider 142 upon reaching capacity. Such an arrangement is particularly useful where the liquid to be stored has a significant amount of suspended solids (for example, sewage from a camp site), and it is desired to at least partially separate the solids from the liquid. In this embodiment, the solids will have an opportunity to settle in the first container area 139 while the "clarified" liquid escapes over the top of the divider 142 into the second container area 140.

FIG. 11 also illustrates a further alternate version of a heating means which may be employed on its own or in addition to the heaters discussed earlier. This system employs a continuous pipe 150 located near the bottom of the first air space 40 and extends circumferentially about the upper inner tank 30. The pipe 150 is connected to a source which circulates a heated liquid therethrough to heat the first air space 46. Such system is advantageously used where glycol is heated elsewhere on site for use in another process. Since the glycol is still warm after use, it may be recirculated through pipe 150 for efficient use and conservation of energy and reduction of heating costs.

In the preferred embodiment, good results have been achieved using an inner tank made of a substantially fiberglass material which is corrosion resistant, economical and simple to fabricate, install and replace. A metal outer tank is preferred for its strength and puncture resistance. It will be understood that other materials and combinations thereof may be employed (e.g. both inner and outer tanks made of metal), depending on local conditions, economies and material availability. Regardless of material, however, a minimum radial distance of at about 1 foot (aprox. 300 mm) should be maintained between the outer shell 44 and the inner sidewall 34, to minimize the chances of having the inner tank damaged by impact or movement of the outer tank. The 1 foot spacing also ensures an upper air space capacity of at least 110% as noted earlier for most anticipated tank sizes, except for exceptionally large tank designs where such spacing may have to be increased.

Many advantages and benefits of the present invention, as well as its operation, may now be better appreciated. First, minimal site disturbance and preparation is required as compared to prior art tanks, particularly underground storage tanks. A site near the well head must be cleared of obstructions and graded to provide a level ground surface 12. Pit excavation (particularly difficult in winter), liners and backfiling is not required, nor the laying of gravel or other substrate, unless the soil is of particularly poor quality. The entire prefabricated containment assembly is then delivered and placed on the prepared surface 12. Once the required external connections are made (e.g. inlet pipe 14 must be connected to the supply for produced water, fuel gas tubing (not shown) must be connected to a fuel gas supply, and instrumentation (not shown) is connected to sensing units), the assembly is ready for use. The average time for preparing the site and setting up the assembly has been found to take less than half a day, and as little as 2 to 3 hours, well below that for underground storage tanks (which is normally in excess of a day). Likewise, removal of an assembly 10 can be completed in about the same time.

Berms and dykes are not required around the assembly 10 because an integral outer containment unit 40 is provided, which not only saves installation/reclamation time and costs, but does not obstruct access to the assembly 10. This also results in much less surface area having to be set aside for the assembly 10 (typically about 120 square feet for 100 BBL tanks) as compared to underground tanks with berms (typically about 300 square feet for 100 BBL tanks).

Easy accessibility to the assembly 10 allows an operator to quickly and conveniently read the level of produced water in the inner tank from the external gauge board, without having to even leave his vehicle. As well, the sight glass 26 is readily reached for rapid confirmation that there is no produced water in the upper air space 46, and so no leakage of the inner tank.

Should produced water be detected in the first air space 46 indicating a leak, the assembly's design and above-ground location results in easy drainage of the outer tank by gravity through drain 47, thus eliminating the need for using more expensive vacuum trucks. Gravity may also be employed for the inner tank. In any event, pump trucks can be used for such liquid removal rather than the more expensive vacuum trucks typically required for belowground tanks. The former trucks also reduce damage to roads and the well site. Upon evacuation of the liquid, the inner tank may then be inspected and, if necessary, repaired or replaced by removing it from the outer tank 40. To remove the inner tank from the outer tank, a circumferential cut in the insulation layer 80 should be made at the gap 78, the inlet pipe 20 should be disconnected from the inner tank via the inspection hatch 28, and the roof and inner tank lifted with a crane or the like. Costly excavation of the site is avoided, as are the chances of damaging the assembly with digging equipment. A new tank may then be reinserted into the outer tank, and the top portion of the insulation layer 80 is replaced and bound to the insulation layer below.

The design of the assembly provides the option of moving and reinstalling the assembly at other sites. Such re-use is difficult, and generally assumed not probable, for underground tanks due to the corrosive effects of soil on metal tanks and the chances of damaging the tank when excavating.

The peripheral heating system of the preferred embodiment of the present invention avoids direct contact and heating of the produced water or other substances stored within the inner tank, but instead heats the created air spaces exterior to and around the tank. Likewise, the means of preventing freezing of the produced water is not solely restricted to an insulation layer which by itself may not be adequate in many temperature extreme climates. The air space and insulation also act to prevent evaporation loss of liquid in the inner tank.

As noted above, the present invention may be used for storing various types of liquid substances, such as lube oil, glycol and many types of chemicals. In certain applications, such as storage of methanol and particular fuels, a steel inner tank is preferably used rather than a fiberglass one for fire retardation. In applications where the substance being stored produces flammable gases which must be sent to flare or a V.R.U. (i.e. vapour recovery unit), a "closed" system design should be employed, namely processing the gases through the scrubber 108 and then a flare stack rather than venting directly to the ambient through the type of vent indicated by 72.

Addition of a sub-base beneath the outer tank 40 provides stiffness and stability to the assembly for easy and safe lifting, moving and transport of the assembly, as well as an air space for insulation purposes.

The above description is intended in an illustrative rather than a restrictive sense and variations to the specific configurations described may be apparent to skilled persons in adapting the present invention to specific applications. Such variations are intended to form part of the present invention insofar as they are within the spirit and scope of the claims below. For example, the heater 62 need not be provided for storage of methanol and fuels/chemicals having freezing points which exceed the coldest air temperatures expected at a particular site.

We claim:

1. An aboveground containment assembly for storing liquids comprising:

an inner tank for receiving and storing said liquids;

an outer tank surrounding said inner tank and forming a first air space therebetween for trapping any of said liquids which might escape said inner tank, wherein said inner tank may be removed for access to said outer tank;

a support means beneath said outer tank for providing a second air space between the outer tank and a ground support surface;

an insulating layer for substantially isolating said inner tank, outer tank and support means from the ambient;

a vapour exhaust means for said inner tank;

pipe means for liquid communication between said inner tank and eternal liquid sources for filling and emptying said inner tank; and measurement means for measuring the amount of liquid in said inner tank and including a shut-off mechanism for stopping the flow of liquid through said pipe means to said inner tank upon said liquid reaching a pre-set level therein as measured by said measurement means.

2. The containment assembly of claim I further comprising a means of promoting air exchange between said first and second air spaces while preventing liquid communication therebetween.

3. The containment assembly of claim 2 wherein said air exchange promoting means comprises a plurality of open ended standpipes spaced about said first air space and in air communication with said second air space.

4. The containment assembly of claim 3 wherein each of said standpipes comprises an elongate hollow tube arranged generally vertically within said first air space and having an open top located at a sufficient height within said first air space to avoid ingress therein of any liquid entering said first air space.

5. The containment assembly of claim 1 further including a heating means for providing heat to said containment assembly to prevent freezing of said liquid in said inner tank.

6. The containment assembly of claim 5 wherein said heating means comprises a heater for heating said second air space, said heating being distributed through an air exchange promoting means into said first air space and about said inner tank.

7. The containment assembly of claim 6 wherein said heater comprises a catadyne type heating unit located within said insulating layer proximate said second air space.

8. The containment assembly of claim 5 wherein said heating means is located substantially outside said insulating layer and includes a conduit for transferring heat from an external heat source to said first air space.

9. The containment assembly of claim 8 wherein said heat source and conduit comprise a fire-tube heating system, said conduit comprising a first portion extending into said inner tank for conveying heated air from said heater to said inner tank and a second portion for venting said heated air from said first portion to the ambient.

10. The containment assembly of claim 8 wherein at least a portion of said conduit is located near a bottom of said first air space and extends circumferentially about said inner tank to provide heat thereto.

11. The containment assembly of claim 1 wherein said measurement means comprises a float within said inner tank which follows the level of liquid therein, and an indicator operatively connected to said float and located outside said insulating layer for indicating the level of liquid within said inner tank.

12. The containment assembly of claim 11 wherein said shut-off mechanism comprises a shut-down means for stopping said liquid flow upon being signalled by said indicator when the liquid within said inner tank reaches said pre-set level.

13. The containment assembly of claim 1 further comprising a roof member for capping said inner tank, wherein an outer periphery of said roof member forms an overhanging portion which extends outwardly of said inner tank over said first air space.

14. The containment assembly of claim 13 wherein said roof member is sufficiently attached to said inner tank to allow withdrawal of the inner tank from said outer tank by lifting said roof member.

15. The containment assembly of claim 13 wherein said vapour exhaust means is located in said roof member for discharging gases from said inner tank to the ambient.

16. The containment assembly of claim 15 wherein said vapour exhaust means includes a liquid scrubber for recovering liquids from said discharging gases and returning said liquids to said inner tank.

17. The containment assembly of claim 16 wherein said liquid scrubber comprises at least one baffle member for intercepting the flow of said discharging gases through said vapour exhaust means, said baffle member providing a surface on which liquids in said discharging gases may collect, said surface being inclined from the horizontal to channel the collected liquids to a collecting means.

18. The containment assembly of claim 17 wherein said scrubber comprises two of said baffle members arranged in a vertically stacked relationship such that said discharging gases contact the lower of said baffle members and are directed onto the other baffle member before discharging to the ambient, and wherein said collecting means comprises said inner tank.

19. The containment assembly of claim 1 wherein said inner tank is constructed of a material from a group consisting of fiberglass and metal materials, and said outer tank is constructed substantially of metal materials.

20. The containment assembly of claim 1 further comprising a shed accessible to a user located adjacent said outer tank and enveloped by said insulating layer for housing said detector and at least a portion of said heating means and said pipe means.

21. The containment assembly of claim 1 further including a detector accessing said first air space to allow confirmation of the absence of liquid leakage from said inner tank into said first air space.

22. The containment assembly of claim 21 wherein said detector comprises a sight glass extending from outside said insulating layer into said first air space for visual inspection thereof.

23. A containment assembly for liquid storage comprising:

an outer tank located aboveground;

an upper inner tank for primary liquid storage removably located within said outer tank so as to form a first air space therebetween for containing any egress of liquid from said upper tank;

a sub-floor assembly beneath said outer tank for elevating and supporting a base of said outer tank aboveground and to form a second air space beneath said outer tank base;

an external insulating layer for substantially isolating said upper inner tank, outer tank and sub-floor assembly from the ambient;

a vapour and pressure exhaust means for said upper inner tank;

inlet and outlet pipe means for filling and emptying said upper inner tank;

measurement means for measuring the amount of liquid in said upper inner tank and including a shut-off mechanism for interrupting the flow of liquid through said pipe means upon said liquid reaching a pre-set level within said upper inner tank as measured by said measurement means; and a detector accessing said first air space for allowing confirmation of any liquid entering therein.

24. The containment assembly of claim 23 further including a means of promoting air exchange between said first and second air spaces while preventing liquid communication therebetween comprising a plurality of open ended standpipes spaced about said first air space and in air communication with said second air space.

25. The containment assembly of claim 24 further including a heating means for providing heat to said containment assembly to prevent freezing of said liquid in said upper inner tank comprising a heater for heating said second air space, said heating being distributed through said standpipes into said first air space and about said upper inner tank.

26. The containment assembly of claim 25 further including a roof member for capping said upper inner tank, wherein said roof member forms an overhanging portion over said first air space and has lifting means for lifting said upper inner tank out of said outer tank.

27. The containment assembly of claim 26 wherein said exhaust means includes a liquid scrubber for recovering liquids from gases discharging from said upper inner tank comprising at least one baffle member for intercepting the flow of said discharging gases and providing a surface on which liquids in said discharging gases may collect, said surface being inclined from the horizontal to channel the collected liquids for return to said upper inner tank.

28. An aboveground containment assembly for storing a liquid comprising:

an inner tank for receiving and storing said liquid;

an outer tank surrounding said inner tank and forming a first air space therebetween for trapping any of said liquid which might escape said inner tank, said inner tank being removably located within said outer tank;

a ground support means beneath said inner and outer tanks;

an insulating layer for substantially isolating at least said inner tank from the ambient;

a vapour exhaust means for said inner tank;

pipe means for liquid communication between said inner tank and external liquid sources for filling and emptying said inner tank; and, measurement means for measuring the amount of liquid in said inner tank, said measurement means including a shut-off mechanism for stopping the flow of liquid through said pipe means to said inner tank upon said measurement means measuring a pre-set level of liquid in said inner tank.

29. The assembly of claim 28 further including a detector accessing said first air space for detecting liquid leakage from said inner tank, thereby allowing confirmation of the absence of said liquid leakage into said first air space.

30. The assembly of claim 28 wherein said ground support means provides a means for insulating said inner and outer tanks from a ground surface.

31. The assembly of claim 28 further including a heating means for providing heat to said containment assembly to prevent freezing of said liquid in said inner tank.

32. The assembly of claim 31 wherein said heating means includes a conduit for transferring heat from an external heat source to said inner tank.

* * * * *